United States Patent [19]

De Witz et al.

[11] 4,444,146

[45] Apr. 24, 1984

[54] ULTRASONIC SUBSURFACE CLEANING

[75] Inventors: Gerhard H. De Witz, La Verne; Bernard W. Yaeger, Glendora, both of Calif.

[73] Assignee: Honeywell Inc., Minneapolis, Minn.

[21] Appl. No.: 339,196

[22] Filed: Jan. 13, 1982

[51] Int. Cl.[3] ..... B63B 59/08

[52] U.S. Cl. ..... 114/222; 134/1; 134/184

[58] Field of Search ..... 114/222; 15/320; 134/1, 134/184; 73/61.2, 597

[56] References Cited

U.S. PATENT DOCUMENTS

| | | | |
|---|---|---|---|
| 2,949,121 | 8/1960 | Kearney | 134/1 X |
| 2,950,725 | 8/1960 | Jacke et al. | 134/184 |
| 2,987,068 | 6/1961 | Branson | 134/184 |
| 3,068,829 | 12/1962 | Nuissl | 134/1 X |
| 3,154,890 | 11/1964 | Lemelson | 134/1 X |
| 4,120,699 | 10/1978 | Kennedy, Jr. et al. | 134/1 |
| 4,307,611 | 12/1981 | Opara | 73/597 |

FOREIGN PATENT DOCUMENTS

| | | | |
|---|---|---|---|
| 1294011 | 10/1972 | United Kingdom | 114/222 |

*Primary Examiner*—Sherman D. Basinger
*Attorney, Agent, or Firm*—George W. Field

[57] ABSTRACT

Apparatus for cleaning marine fouling material from a submerged surface, including a submersible unit movable along a submerged surface to be cleaned, and ultrasonic means carried by the unit and energizable to create a zone of cavitation at the surface, so that movement of the unit moves the zone along the surface to clean fouling material therefrom.

1 Claim, 3 Drawing Figures

ULTRASONIC SUBSURFACE CLEANING

TECHNICAL FIELD

This invention relates to the field of marine engineering, and more specifically to apparatus for removing fouling material from the submerged surfaces of marine vessels and structures without drydocking.

BACKGROUND OF THE INVENTION

The problem of marine fouling is of long standing. Any object which remains under water for an extended period of time becomes coated with various types and numbers of marine organisms, which settle in a general progression and sequence. On a clean surface there first collects a coating of a fine detritus which is followed by a bacterial coating and then a scummy algal growth, then by the attachment of larvae, and the growth of adult population which varies dependent on what larvae settle first. The large and abundant growth of algae can create a severe "soft" fouling condition, and the calcareous shells of acorn barnacles and serpulids are the primary cause of "hard" fouling.

The presence of fouling on a vessel's hull has well known detrimental effects. It reduces the top speed of the vessel, increases the power consumption and decreases the maximum range. It may also accelerate corrosion of hulls and structures. On sonar domes it reduces sonar performance by severely increasing "flow noise" thereby reducing substantially the signal-to-noise ratio.

Numerous preventive or anti-fouling methods have been proposed, the most successful of which is presently the use of toxic paint coatings. The practical life of such coatings is generally less than a few years, and the application and renewal of the paint requires drydocking of the vessel. Water jets, steam jets, abrasive cleaners and scrubbing are effective for removing fouling, but are very time consuming and cost prohibitive for frequent use. Cleaning while afloat is a desirable goal since anti-fouling paints and coatings cannot solve the problem alone.

A number of underwater brushing systems for cleaning ships while afloat are in use. These scrubbing systems are effective but time consuming, expensive, damage the paint, and are difficult to employ frequently and require diver control on most surfaces.

BRIEF DESCRIPTION OF THE INVENTION

The present invention comprises cleaning and inspection apparatus for removing fouling matter by the use of a cavitation zone applied to the surface to be cleaned by ultrasonic transducers mounted in a frame which is moved along the surface for the most part by controls located above the waterline, although the inventive principle is also applicable in smaller, diver-operated equipment for use in special locations. The fouling material removed from the surface may be collected for appropriate disposition, instead of being discharged to the environment, and may have commercial value.

Various advantages and features of novelty which characterize the invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there are illustrated and described certain preferred embodiments of the invention.

DESCRIPTION OF THE DRAWING

In the drawing, in which like reference numerals indicate corresponding parts throughout the several views.

DESCRIPTION OF THE PREFERRED EMBODIMENTS

Figure 1:
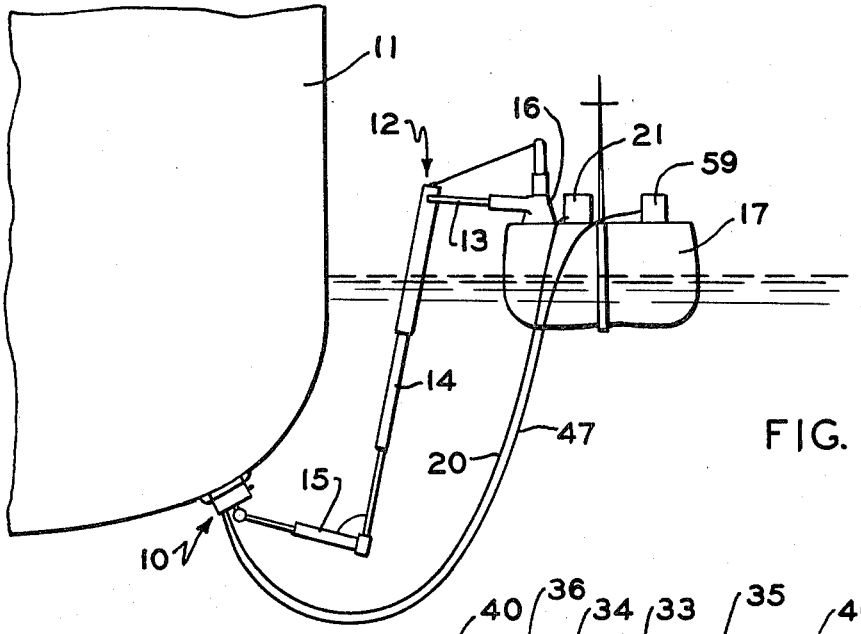
FIG. 1 shows a cleaning system according to the invention in operation.

FIG. 1 shows a cleaning and inspection unit 10 according to the invention, in use to separate fouling material from the plating of a floating marine vessel 11. Unit 10 is mounted on an adjustable support 12 comprising mechanical, electrical or hydraulic means such as telescopic arms 13, 14 and 15 angularly and linearly adjustable from a control station 16 positioned at a site above the water level, as on a work boat 17 or other appropriate location such as a truck on a pier adjacent to the vessel to be cleaned, or even on the vessel itself. Unit 10 is connected by a suitable cable 20 with a control and observation station 21 on boat 17.

Figure 2:
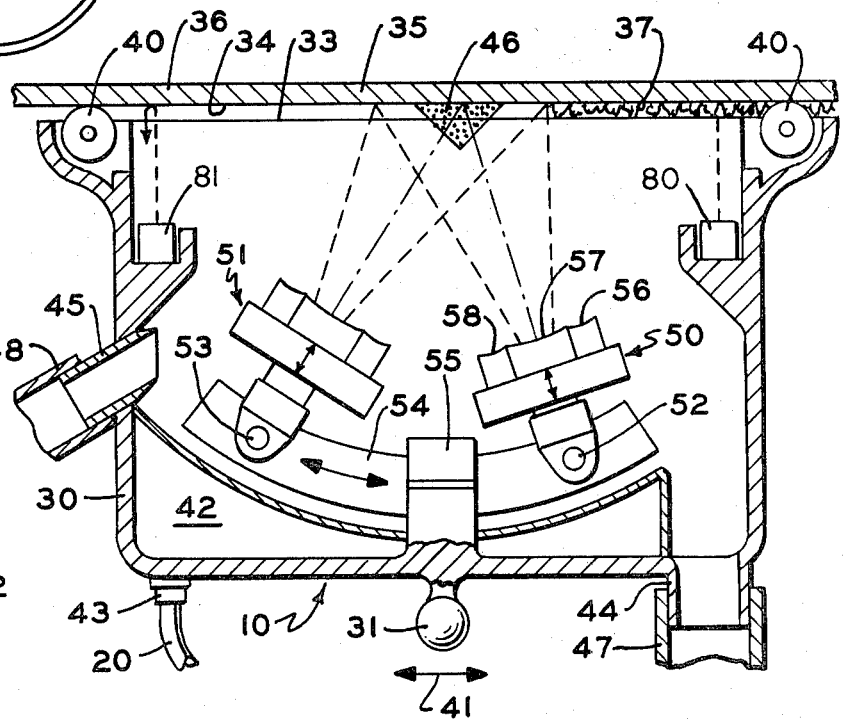
FIG. 2 is a transverse cross-sectional view of a cleaning and inspection unit according to the invention, shown somewhat schematically.

FIG. 2 shows unit 10 in a transverse section, somewhat schematically. It comprises a housing or casing 30 carrying the ball 31 of a universal joint for connection to arm 15 of support 12. Casing 30 is elongated in a direction normal to the paper, and one side of the housing has a large opening 33 for apposition with the outer surface 34 of the plating 35 of the vessel: the inner surface of the plating is shown at 36, and the fouling material to be removed is shown at 37. Wheels or rollers 40 are provided to space unit 10 appropriately from plating 35 and to assist the movement of the unit in the direction of arrow 41. Housing 30 includes a flotation chamber 42 to create neutral or positive buoyancy for the unit, and also includes an electrical connector 43 for cable 20 and a pair of hose connections 44 and 45.

Housing 30 encloses a plurality of transducer assemblies mounted in pairs spaced along the housing to direct pulsed or continuous wave ultrasonic energy through the water in the housing to produce a cavitation zone 46 through the opening 33 on the surface 34. Transducer assemblies 50 and 51 are pivotly mounted by fasteners 52 and 53 on an arm 54 adjustably secured to housing 30 by a clamping mechanism 55. The remaining pairs of transducer assemblies are similarly mounted. These transducer assemblies may be of identical construction, so that zone 46 will extend the length of the housing to act on surface 34 as a swath of cavitation of acceptable width during advance of the unit. Assembly 50 will now be described in detail.

As suggested in the drawing, assembly 50 comprises a plurality of ultrasonic transducer elements 56, 57 and 58, with selected resonant frequencies and electrically energized by cable 20 received at connector 43. Transducers 56 and 58 have the same resonant frequency, for example, 180 KHz, and transducer 57 has a different resonant frequency such as 210 KHz. Other frequency combinations may be utilized for specific conditions. The transducer elements are shaped, or provided with lenses of suitable material such as polystyrene, so that the beam of ultrasonic energy from each is focused as a narrow band extending along a zone 46 of cavitation which is continuous the length of housing 30. The energization of the transducers is at a level just below the onset of cavitation at their faces, but results in cavitation where their beams overlap. This also results in nonlinear interaction between the beams and generation of sum and difference frequencies. A difference frequency of 30 KHz is believed to be especially effective in separating most types of fouling materials from the surfaces. Other types of fouling may require lower or higher frequency combinations of the summation of the power outputs of the transducers which produces strong cavitation at a sufficient distance from the transducer faces to avoid damage to them.

A pump 59 on boat 17 is connected to unit 10 at hose connection 44 by a hose 47 to draw from chamber 30 water carrying the separated fouling material, so that the environment is not polluted with removed fouling material. This material may in fact have some commercial value, and is appropriately collected. The pump also may act to create a slight negative pressure within the chamber to hold the unit against the surface. This can be augmented if desired with pressure exerted by means 12, 13, 14 and 15. If desired, chemicals or abrasives may be supplied to housing 30 in a slurry through an additional hose 48 fastened to connector 45.

A pair of ultrasonic transceivers, 80 and 81 are provided in association with each pair of transducer assemblies 50, 51 and are energized through connector 43. Transceiver 80 functions to measure the thickness of the fouling material 37, and its output is transmitted through cable 20 to control station 21 to assist in determining the appropriate rate of motion of unit 10 along the vessel. Transceiver 81 functions to measure the thickness and integrity of the plating 35 after the fouling material has been removed; its output is transmitted through cable 20 to control station 21 to enable inspection concurrent with the cleaning process.

It is intended that unit 10 may also be provided with under-water television equipment by which the action of the unit may be observed at control station 21. Moreover, although operating as transmitters at frequencies selected for the specific purposes, units 80 and 81 also act as detectors of the cavitation produced in zone 46 by assemblies 50 and 51, and hence are of further assistance at the control station in the management of unit 10. Under appropriate circumstances units 80 and 81 can be receivers only, activated by energy from transducer assemblies 50 and 51.

Figure 3:
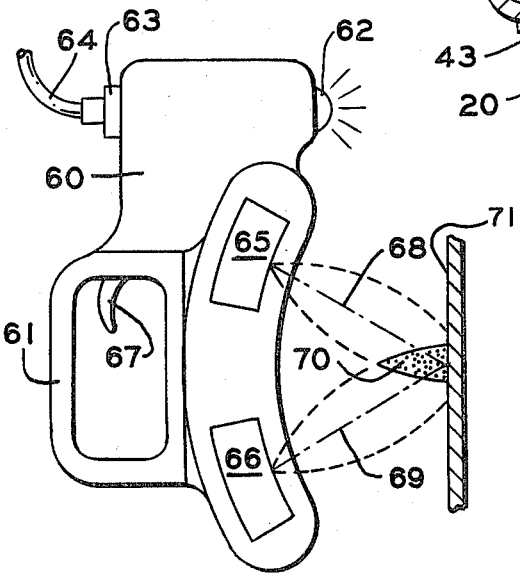
FIG. 3 shows a second embodiment of the invention.

FIG. 3 shows somewhat schematically an embodiment of the invention intended for hand-held use by divers at areas of a vessel's plating or other underwater structure the size or configuration of which make the larger unit of FIG. 2 inappropriate. It comprises a housing 60 with a handle 61, an illuminator 62, and a connector 63 for energizing cable 64. A pair of shaped, elongated ultrasonic transducer elements 65 and 66 are mounted in housing 60, adjustably, if desired, and are energized, by operation of a switch 67, at power levels just below the onset of cavitation at their faces, to emit beams 68 and 69 of ultrasonic energy which intersect at a distance from the transducer faces to produce an area 70 of strong cavitation which may be apposed to the surface 71 for removing fouling materials therefrom as previously described.

From the foregoing, it will be evident that the invention comprises apparatus for cleaning fouling material from the plating of a vessel afloat or other under-water surface by the use of cavitation provided by ultrasonic transducer elements by focussing and directing their beams to intersect at the area to be cleaned, and that inspecting functions can be combined with the cleaning functions, if desired.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, frequencies and arrangement of parts, within the principle of the invention, to the full extent indicated by the broad general meaning of the terms in which the appended claims are expressed.

The embodiments of the invention in which an exclusive property or right is claimed are defined as follows:

1. Apparatus for cleaning marine fouling material from a submerged surface, comprising, in combination:

a submersible housing moveable along a submerged surface to be cleaned and having an opening for apposition with said surface;

and first and second transducer assemblies carried by said housing and having radiating surfaces for directing beams of ultrasonic energy to intersect at a zone of cavitation at said submerged surface, said assemblies comprising transducers operable at different frequencies and at levels of excitation just below the onset of cavitation at their radiating surfaces, so that said beams combine and result in cavitation and non-linear interaction in said zone, to give sum and difference frequencies; and means mounting said assemblies in pairs spaced along said housing, each mounting means comprising an arcuate member slideable transversely of said housing, means pivoting said assemblies to said arcuate member at sites spaced therealong, and means clamping said member to said housing at a site between the sites of pivoting of said assemblies.

* * * * *